US005152133A

United States Patent [19]

Pierino et al.

[11] Patent Number: 5,152,133

[45] Date of Patent: Oct. 6, 1992

[54] METHOD AND MACHINE FOR THE AUTOMATIC FORMATION OF ORNAMENTAL CHAINS WITH EIGHT-SHAPED LINKS

[75] Inventors: Maruffl Pierino; Chiaramonti Stefano, both of Arezzo, Italy

[73] Assignee: I.C.M.S.r.l. Italiano Costruzioni Metalmeccaniche

[21] Appl. No.: 547,461

[22] Filed: Jul. 2, 1990

[30] Foreign Application Priority Data

Jul. 13, 1989 [IT] Italy ..... 9477 A/89

[51] Int. Cl.[5] ..... B21L 7/00

[52] U.S. Cl. ..... 59/18; 59/3; 59/20

[58] Field of Search ..... 59/1, 3, 16, 17, 20, 59/18

[56] References Cited

U.S. PATENT DOCUMENTS 1,479,870 1/1924 Payette ..... 59/16

4,972,670 11/1990 Lapini et al. ..... 59/20

FOREIGN PATENT DOCUMENTS 0097829 4/1961 Norway ..... 59/17

*Primary Examiner*—David Jones

*Attorney, Agent, or Firm*—McGlew & Tuttle

[57] ABSTRACT

Chains having links in the shape of a figure eight can be made by the method and apparatus of the present invention. The last link of the chain is first held in a secure position. Oval shaped loops are cut from an oval shaped helix in such a manner that the ends of the loops are spaced apart. The ends of the loops are then passed through the eyes of the held last link of the chain. The ends of the loop are then closed and the loop is then grasped at opposite ends of the oval and twisted to form the figure eight shape. The present invention has a collet 30 for holding the last link of the chain, a collet 40 for grasping the loops created from the oval shaped helix. The collet 40 is movable for insertion of the arms of the loop into the eyes of the last link. A clamp 50 joins the ends of the loop and the clamp 50 and collet 40 then perform a twisting motion which results in the loop being formed into a figure eight shape.

21 Claims, 6 Drawing Sheets

METHOD AND MACHINE FOR THE AUTOMATIC FORMATION OF ORNAMENTAL CHAINS WITH EIGHT-SHAPED LINKS

FIELD OF THE INVENTION

The present invention refers to a method for the formation of chains with "figure eight"-shaped links for necklaces, bracelets, belts and the like, and to a machine for carrying out said method.

BACKGROUND OF THE DRAWINGS

Chains are known which are currently made by hand starting from open links, that is, links having and oval helix-like profile and a pitch is approximately equal to twice the thickness of the wire from which they are made. Each link being fir linked by the insertion and rotation of an open link with respect to the link last linked. The open link is then closed and finally twisted to achieve the shape of an eight.

Obviously, the manual formation of such chains calls for a great deal of time, great care and accuracy by the operator. The manufacturing costs therefore cause the production to be restricted to chains of precious metal such as gold, silver and other less noble metals.

The present invention has the object to eliminate the above mentioned drawbacks by providing a method and a machine for mechanically and automatically making chains with figure eight-shaped links so as to increase the accuracy, rate and reliability of production and, thereby, drastically reducing the manufacturing costs.

This object has been achieved, according to the invention, by implementing a method which comprises, in sequence, the following steps:

holding, in a predetermined joining position, the link of the chain which has been last linked; an separately:

gripping a loose and open link from a machine forming of oval helix-shaped links;

positioning said loose and open link into a plane substantially orthogonal to the one of the blocked link of the chain;

introducing the two arms of said loose and open link into the corresponding eyes of the held link and rotating the latter about its own axis to achieve the joining;

leaving the held link of the chain;

closing the spread apart ends of the loose link so joined and twisting it to form an eight.

According to a preferred embodiment, a machine for the automatic formation of chains with figure eight-shaped links according to the said method, comprises:

means for positioning the last link of the chain, in the course of formation, to allow for the passive joining of a corresponding loose and open link;

means for moving each loose and open link made from a wire bent in the form of an oval helix by a "screw-nut machine[ transfer of the same link to a position for the active joining thereof with the corresponding last link of the chain and, subsequently, moving the last link to a successive position for the closing and twisting thereof;

means for closing each loose and open link after the joining thereof and for performing the figure eight-shape twist thereof.

The advantages attained by the present invention consist essentially in that it is possible to mechanically and automatically form chains with figure eight-shaped links; it is possible to drastically reduce the production times and, therefore, the relevant costs and that it is possible to increase the uniformity and reliability of the finished product, yet maintaining a versatility as far as the geometrical dimensions and the nature of the material of the links are concerned.

These and further advantages and characteristics of the invention will be more and better understood by any skilled in the art from the following description in conjunction with the attached drawings given as a practical exemplification of the invention, but not to be considered in a limiting sense; wherein:

DETAILED DESCRIPTION OF THE PREFERRED EMBODIMENT

Figure 1:
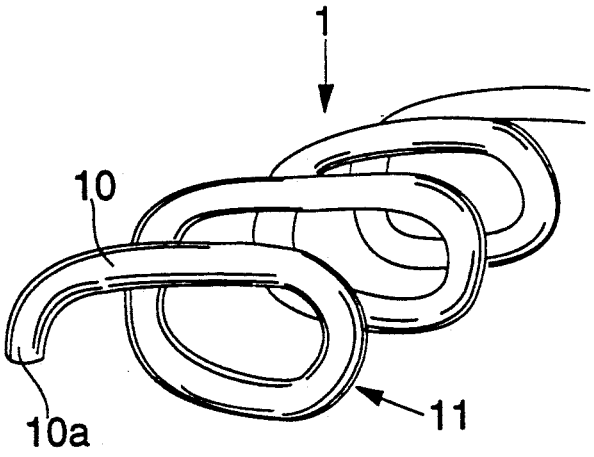
FIG. 1 is an enlarged view of an oval helix-bent wire for eight-shaped links.
Figure 4:
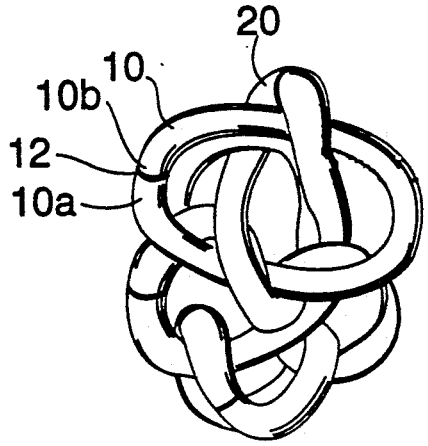
FIG. 4 is a view of the link of FIG. 3 after the closing thereof.
Figure 2:
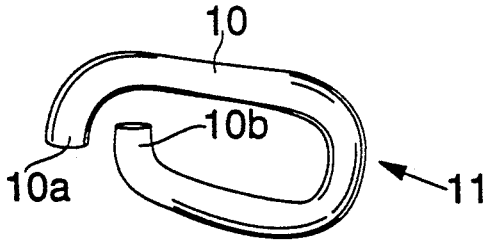
FIG. 2 is an enlarged view of a loose and open link made from the coil of FIG. 1.
Figure 5:
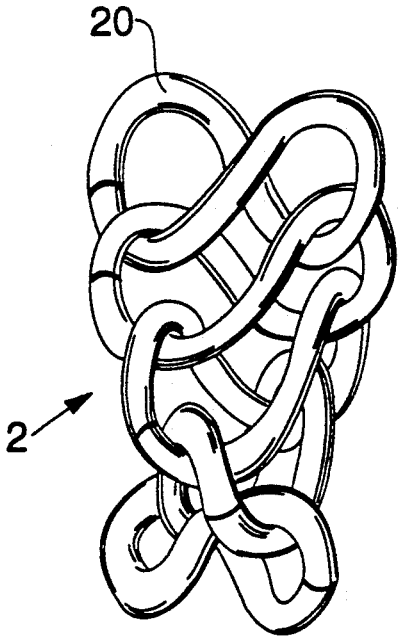
FIG. 5 is a view of the link of FIG. 4 after the eight-like twisting thereof.
Figure 3:
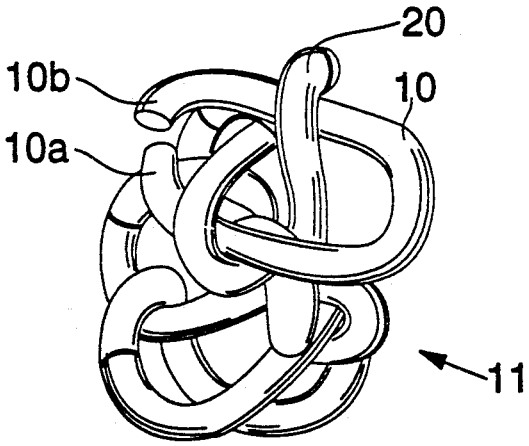
FIG. 3 is a view of the link of FIG. 2, after its joining with the last link of an already formed chain.

The oval helix-shaped link 10 of FIG. 2 is detached from a coil 1 made, with known means, by using a wire of predetermined nature and diameter, bent to form an oval helix, with a pitch two times larger than the diameter of the wire; said link is cut to obtain a development of almost 360° between the two ends 10*a*, and 10*b* which result is the ends being spread apart and opposite hooked. With reference to FIGS. 3 to 5 of the accompanying drawings, the method for the formation of chains with eight-shaped links, according to the invention, includes, in sequence, the following steps:

positioning the last link 20 of chain 2 in the process of formation by holding it in the area just below the interruption 12 and in such a way as to make the last link 20 substantially lie in a vertical plane with its longitudinal axis horizontally disposed;

gripping the first loop 10' of the coil 1 by holding it by its central, that is, median zone 11 and in such a way as to result in the first loop 10' substantially lying in a vertical plane and with its longitudinal axis horizontally disposed;

detaching said loop 10' from the coil 1 thereby obtaining an open and loose link 10;

positioning the open and loose link 10 in a horizontal plane with its longitudinal axis substantially orthogonal to that of the last link 20 of chain 2 and so as to have its free ends 10*a*, 10*b* facing the corresponding eyes of last link 20;

introducing the spread apart arms of the link 10 into the eyes of last link 20, followed by the rotation of approximately 45° of the last link 20 around its own axis and simultaneous horizontal moving backward of last link 20 to obtain the joining of loose link 10 with chain link 20;

releasing the last link 20 of the chain;

positioning the thus joined link 10 in a vertical position with its [longitudinal] axis horizontally disposed;

moving together and holding the spread apart ends 10*a*, 10*b* of link 10 thus achieving their closing;

rotating the central or median zone 11 of the thus closed and positioned link 10 by approximately 140° about its longitudinal axis and simultaneously shortening same link by a figure eight-forming twist;

releasing the said thus closed ends 10*a*, 10*b* of link 10 for the transfer thereof while holding it by the zone just below the interruption 12;

releasing the central, that is, median zone 11 of link 10;

rotating the thus obtained last link 20 of the chain of approximately 90° about a vertical axis in order to dispose it into a position of passive joining thereof with a next loose and open link 10.

Figure 6:
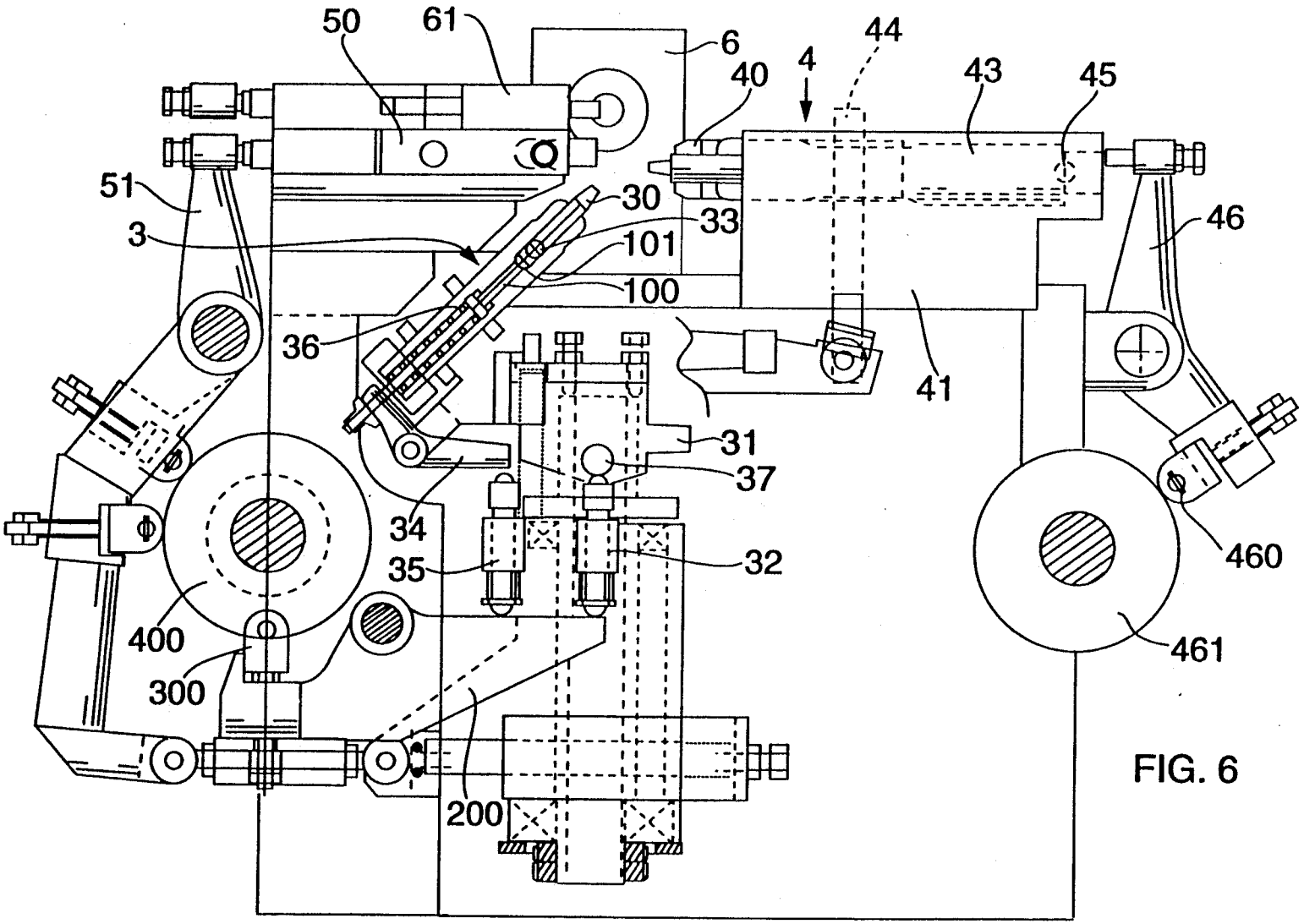
FIG. 6 is a front view of a preferred embodiment of a machine for the formation of chains according to the invention, associated to a screw-nut machine for oval helix-shaped wire.
Figure 7:
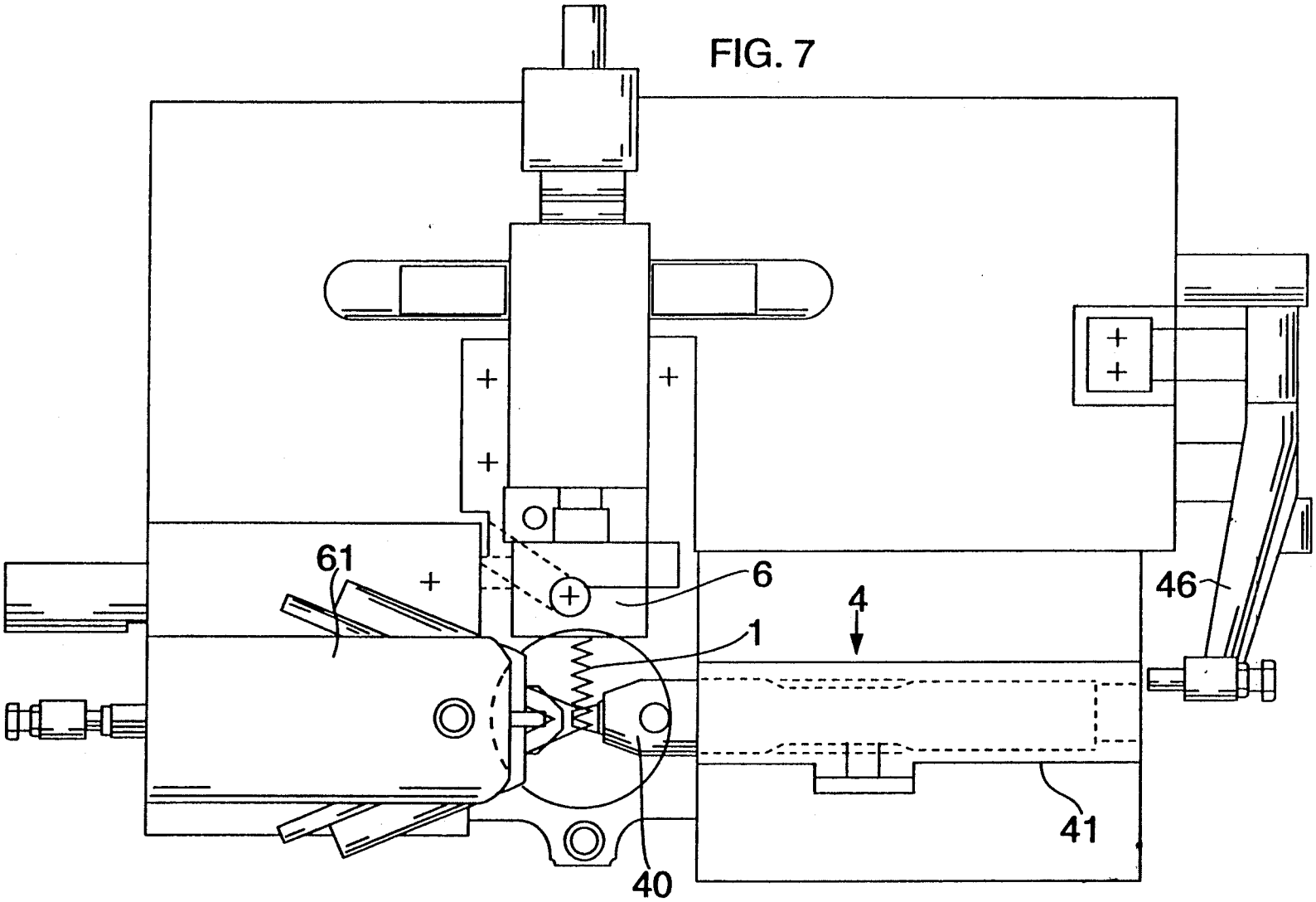
FIG. 7 is a plan view of the machine of FIG. 6.

According to a preferred embodiment a machine for implementing the method according to the invention, with reference to FIGS. 6 and 7 of the attached drawings, comprises:

means for positioning the last link 20 of chain 2 in the course of formation, by a group 3 carrying an upwardly inclined first collet means 30. The first collet means 30 in group 3 is associated with a support 31 which is mounted on a rotating vertical shaft 32. The support 31 can oscillate about a first horizontal pivot 37 in order to permit the rotation of the collet means 30. This allows the collet means 30 ti insert the spread-apart arms of the loop into the eyes of the last link of the chain and, subsequently, move backward in order to start a new step of the process. The shaft 33 of first collet means 30 being engaged with a rocker lever 34 provided with tappet 35 and a spring 36, which controls the opening and closing the the first collet means 30;

The jaws of the first collet means 30 are connected with the front end 101 of a rod 100. The rod is inside the group 3 and is caused to oscillate internally to the first collet means 30 by means of a corresponding rocker lever 34 provided with a tappet 35. The tappet 35 is caused to translate alternatively by means of a lever 200 moved by a cam 300 associated with a rotor 400. The motion of the rod 100 being countered by a counteracting spring 36.

When the cam 300 causes the rotation of the lever 200 about its axis, the tappet 35 is moved up. The consequent rotation of the rocker lever 34 causes the moving backward of the rod 100 so that the jaws of the first collet means 30 are opened.

Then the tappet 35 is released by the lever 200, the tappet 35 moves down and the rod 100 is consequently caused to move up by means of the counteracting spring 36, so that the jaws of the collet means 30 are closed.

means for the transfer of each loose and open link 10 held by a machine 6 for the formation of the open links, for the active joining thereof with the last link 20 of chain 2 and for the introduction thereof into the closing means and, finally, for the figure eight-like twist thereof by a group 4 carrying a collet 40 with rotating horizontal shaft. The second collet means in group 4 is caused to oscillate about a second horizontal pivot 45 by means of the rocket lever 46. The rocker lever 46 is driven by the cam 460 associated with the rotor 461 in order to obtain the rotation of the second collet means 40. The second collet means 40 is rotated for the correct inserting of the spread-apart arms of the loop into eyes of the last line of the chain. The shaft 43 of second collet means 40 being further engaged to a rocker lever with tappet and to a spring (not shown for the sake of clarity) to achieve the opening and, respectively, the closing of collet 40;

clamp means for the closing of each loose and open link 10 after the joining thereof and in cooperating for the figure eight-like twisting thereof with a fixed clamp 50, the parallel jaws of fixed clamp 50 have an indentation able to receive the free and spread-apart ends 10*a*,10*b* of each link, when each link 10 has its axis horizontally disposed, the closing movement of the jaws causing the closing and clamping of said link;

means for the formation of the oval coil 1 by a known per se "screw-nut" machine 6, disposed at fixed position close to said clamp 50 so that the horizontal axis of the coil is perpendicular to the axis of collet 40 and the machine 6 has a cutter group 61 for the detachment of each loop 10' corresponding to an open link 10.

Figure 8:
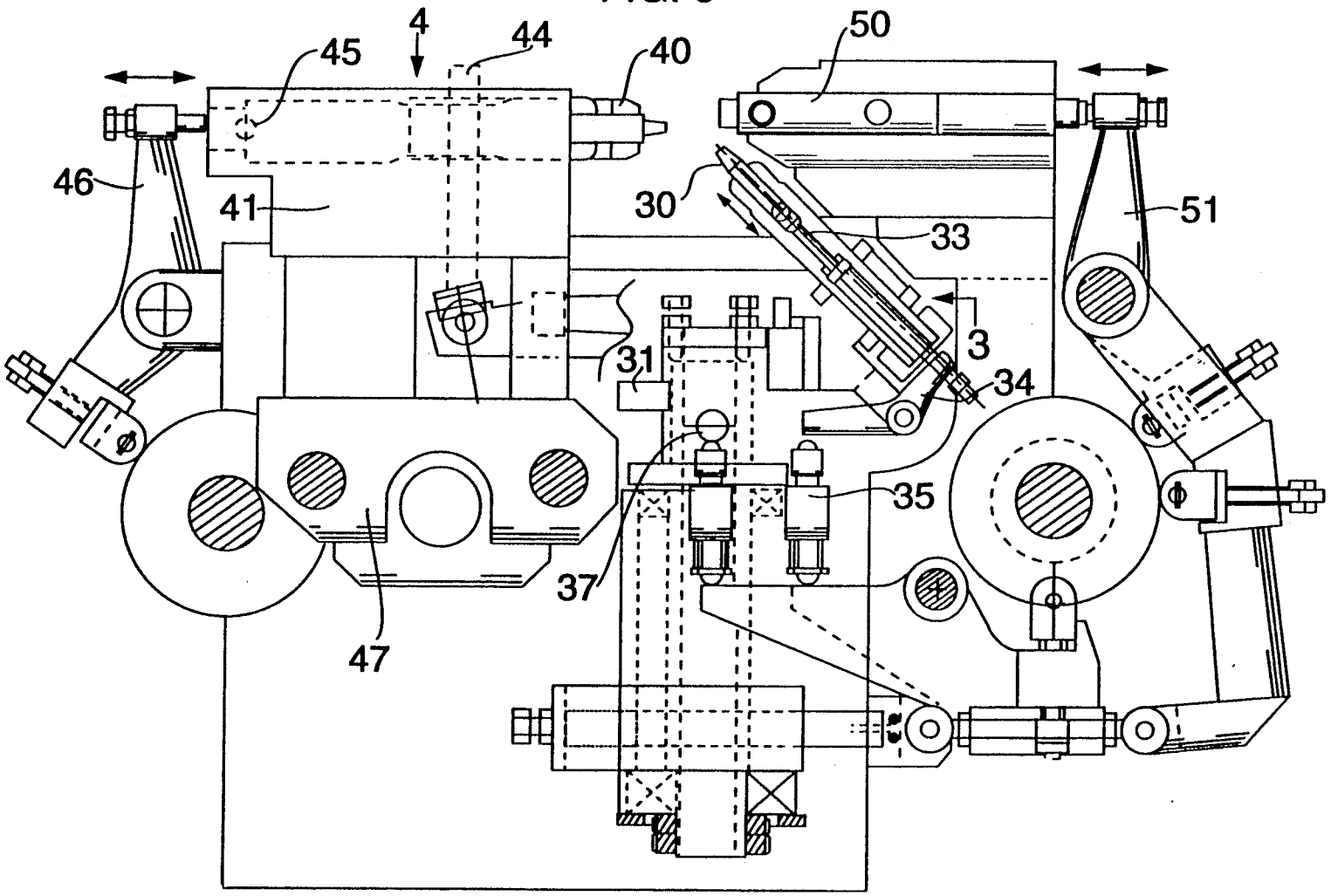
FIG. 8 is a front view of a modified version of the machine of FIG. 6.
Figure 9:
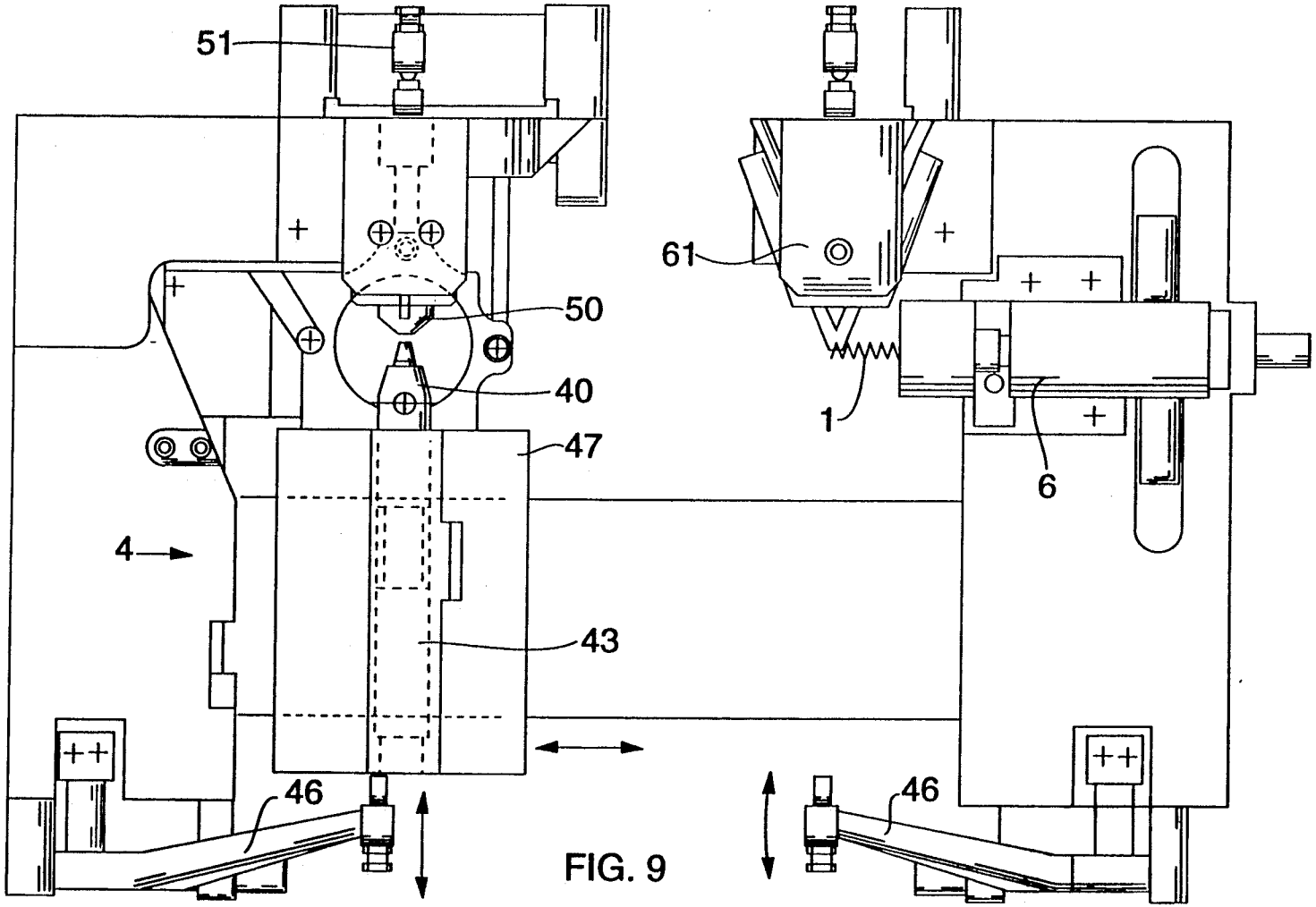
FIG. 9 is a plan view of the machine of FIG. 8.
Figure 10:
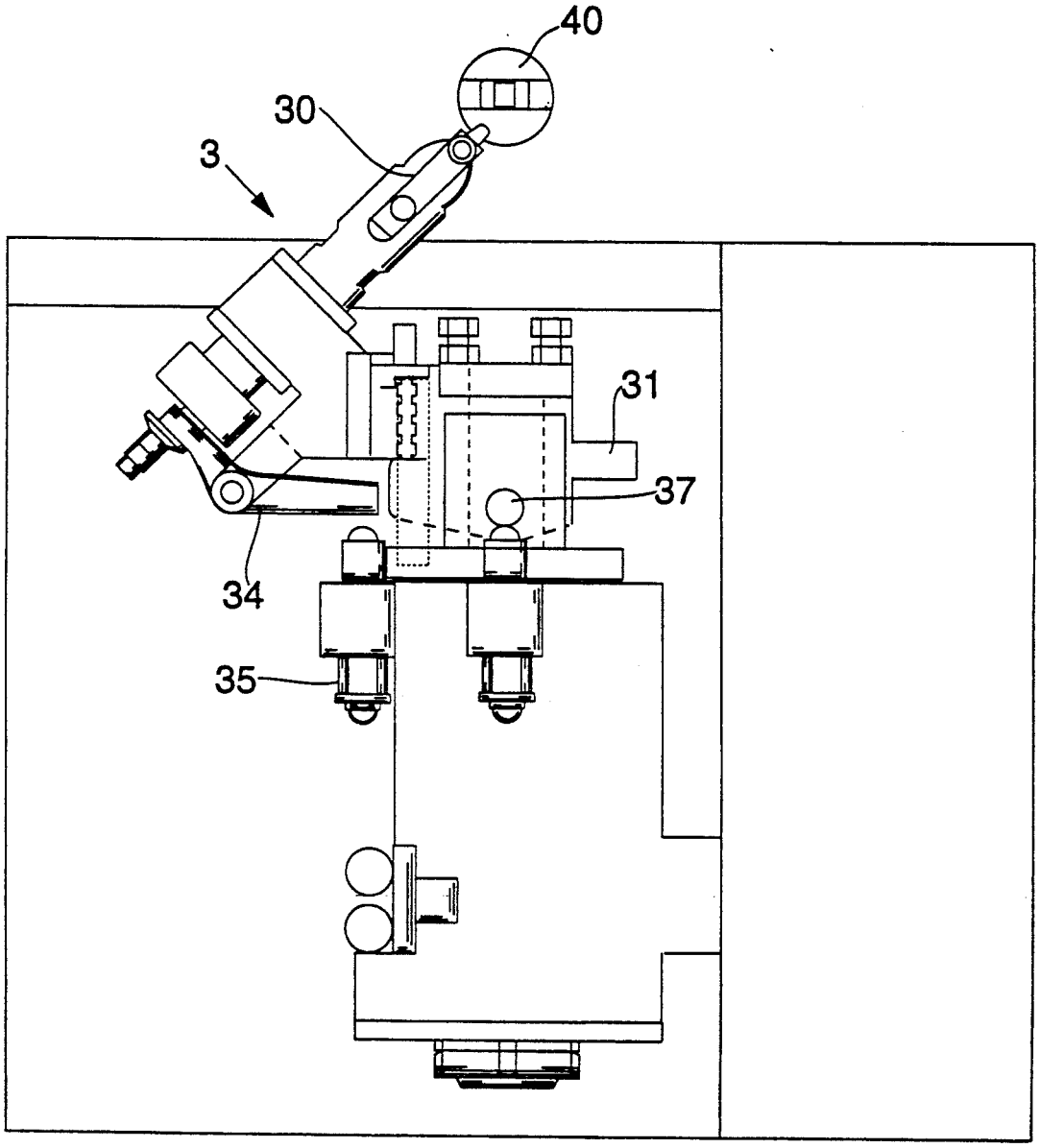
FIG. 10 is a right side view of the modified version of FIG. 9.

According to the invention and with reference to FIGS. 8 to 10 of the attached drawings, a modified version of said machine is provided in which said group 4 for moving the open links 10 are mounted on a carriage 47 horizontally movable from a position for the gripping of each link formed by the "screw-nut machine" to a position for the active joining thereof with the last link of the chain in the process of formation.

To this end, the screw-nut machine 6 is placed at a distance from the clamp 50.

Such disposition utilizes three independent actuators, the first of which is intended to drive the shafts which move the screw-nut machine 6, the cutter group 61 and the group 4. Upon the link-forming step; the second actuator is for driving the carriage 47 with group 4. The third actuator is for driving the cam shafts which move the group 3 with collet 30, clamp 50 and group 4, upon the link-forming step. This allows a more extended work phase for each group.

The process of adding a link to a chain in the course of formation by the machine illustrated in FIGS. 6 and 7 of the attached drawings is as follows.

While the collet 30 is closed on the last link 20 of the chain 2, keeping it in a substantially vertical plane with its axis horizontally disposed, the open collet 40 is drawn near the coil 1 coming out from the screw-nut machine 6 and then closed on the median zone 11 of the first loop 10' of coil 1. After the cutter group 61 has cut said loop 10', the collet 40 moves back and then rotates downwards by a small extent about its axis in order to have the free, spread apart ends 10*a*,10*b* of the thus kept open link 10 facing the eyes of link 20. Thereafter, the collet moves forwards for introducing the arms of the open link 10 into the eyes of link 20 and rotates at the same time about its own axis through approximately 45° while the collet 30 moves back a small extent. Upon completion of the joining, the collet 30 leaves the link 20, the chain 2 being kept by the collet 40 half-way from the already joined but still open link 10. At this point, the collet 40 moves back and rotates about its own axis so as to position the link 10 in a vertical plane, after which it moves forwards until the spread-apart ends 10*a*,10*b* of link 10 are introduced between the jaws of clamp 50. At this point the clamp 50 is made to close, thereby closing the link and keeping it steady while the collet 40, by rotating of about 45., twists it into an eight-like shape by favouring the relative shortening thereof.

Finally, the clamp is made to open, the collet 40 is moved back and lowered down to hand over the so closed and twisted link 20 to the collet 30 which grips it just under the interruption 12, then rotates it about a vertical axis to place it in the passive joining position.

It is understood that a machine according to the invention is easily adaptable to any type of oval helix-shaped link by a replacement of only the interchangeable wire-measuring devices and a consequent adjustment of the means for the movement of links 10,20.

Practically, the construction details may vary in any equivalent manner as far as the form, dimensions, elements disposition, nature of used materials are concerned, without coming out from the scope of the solution idea and, therefore, remaining within the limits of the protection granted by the present patent for industrial invention.

We claim:

1. A method for the formation of chain with figure eight-shaped links, the method comprising the steps of:
- holding a last link of the chain;
- griping a loop from an oval helix;
- detaching said loop from said oval helix;
- inserting spread-apart arms of said loop into eyes of said last link of chain;
- rotating said loop to complete joining;
- clamping said spread-apart arms of said loop to obtain a closed link;
- rotating one end of said closed link with respect to another end of said closed link along a longitudinal axis of said closed link in order to from a figure eight-shaped link, said figure eight-shaped link now becoming a new last link in the chain;
- releasing previous said last link of the chain and holding said new last link of the chain.

2. A method according to claim 1, wherein:
- said last link of the chain is held just below an interruption zone.

3. A method according with claim 1, wherein:
- said loop from said oval helix is gripped in a median zone.

4. A method according to claim 1, wherein:
- said detaching of said loop from said oval helix is done in a manner so as to obtain two free, opposite hooked ends.

5. A method according to claim 1, wherein:
- said last link of the chain is in a substantially vertical plane with a longitudinal axis of said last link being substantially horizontal.

6. A method in accordance with claim 1, wherein:
- said loop is in a substantially horizontal plane with said longitudinal axis of said loop being substantially orthogonal to a longitudinal axis of said last link of the chain during said inserting.

7. A method according to claim 1, wherein:
- said rotating of said loop after insertion into said last link of the chain for joining in approximately 45°.

8. A method in accordance with claim 1, wherein:
- said rotation of said one end of said closed link with respect to another end of said closed link is approximately 140°.

9. A method in accordance with claim 1, further comprising:
- rotating said new last link approximately 90° about a vertical axis.

10. A method in accordance with claim 1, wherein:
- said oval helix is positioned with an axis of said oval helix being substantially horizontal.

11. An apparatus for the formation of figure eight-shaped links on a chain, the apparatus comprising:
- a first collet means for holding a last link of the chain;
- a screw-nut machine means for creating a coil in the shape of an oval helix;
- detachment means for detaching a loop from said coil, said loop having spread apart and hooked arms;
- a second collet means for holding said loop and inserting said spread apart arms of said loop into said last link of the chain;
- clamp means for combining said spread apart arms of said loop and holding said loop; and
- twisting means attached to said second collet means for rotating said second collet means with respect to said clamp means while said second collet means and said clamp means hold said loop.

12. An apparatus in accordance with claim 11, wherein:
- said clamp means has one set of jaws for both combining and holding said spread apart and hooked arms of said loop, said clamp means remaining stationery during said rotating of said twisting means.

13. An apparatus in accordance with claim 12, wherein:
- said first collet means is attached to a support, said support having first means for rotating said support on a vertical shaft, and said support also having a second means for pivoting said support on a first horizontal pivot, said first and second means of said support also being for moving said first collet means into a position for inserting said spread-apart and hooked arms into said last link of the chain, and subsequently moving said support backward;
- said second collet means having pivot means for oscillating about a second horizontal pivot, said pivot means also for positioning said spread-apart and hooked arms for insertion into said last link of the chain; and
- said one set of jaws of said clamp means having an indentation corresponding to said loop.

14. An apparatus in accordance with claim 11, wherein:
- said second collet means and said clamp means have axes lying in a vertical plane of said loop.

15. An apparatus in accordance with claim 11, wherein:
- said first collet means has a mouth at a spaced distance lower than said clamp means.

16. An apparatus in accordance with claim 11, wherein:
- said clamp means is at a fixed positioned underlying said detachment means and adjacent said screw-nut machine means.

17. An apparatus in accordance with claim 11, wherein:
- said screw-nut machine means and said detachment means are spaced at a relatively distant position from said clamp means.

18. An apparatus in accordance with claim 11, wherein:
- said second collet means has a carriage means for performing horizontal travel transverse to an axis of said second collet means, said horizontal travel being from a gripping position where said second collet means first holds said loop to a joining and closing position where said loop is joined and closed by said clamp means.

19. An apparatus in accordance with claim 18, further comprising:

a screw-nut cam shaft driving said screw-nut machine means;

a detachment cam shaft driving said detachment means;

a first actuator rotating said screw-nut cam shaft and said detachment can shaft, for said driving of said screw-nut machine means and said detachment means, respectively;

a second actuator driving said carriage means;

a first collet cam shaft driving said first collet means;

a second collet cam shaft driving said second collet means; and a third actuator rotating said first collet cam shaft and said second collet cam shaft.

20. An apparatus in accordance with claim 11, wherein:

said first collet means is inclined at an angle to said second collet means, said first collet means having a first collet means rotor, a first collet means cam being moved by said first collet means rotor, a first collet means lever being moved by said first collet means cam, a first collet means tappet being moved by said first collet means lever, a first collet means rocker lever being moved by said first collet means tappet, a first collet means rod having a counteracting spring and said first collet means rod being moved by said first collet means rocker lever, said first collet means having jaws connected with a front end of said rod, rotation of said first collet means rotor moving said first collet means cam, lever, tappet, rocker lever, rod and jaws, for opening and closing said jaws of said first collet means.

21. An apparatus in accordance with claim 11, wherein:

said first collet means has jaws, said jaws being opened and closed by a movement of a first collect means rocket lever, said first collet means rocker lever being moved by a first collet means cam rotor;

said second collet means has jaws, said jaws being opened and closed by a movement of a second collet means rocker lever, said second collet means rocker lever being moved by a second collet means cam rotor; and a common actuator driving both said first collet means cam rotor and said second collet means cam rotor.

* * * * *